US009647371B2

(12) United States Patent
Thurau et al.

(10) Patent No.: US 9,647,371 B2
(45) Date of Patent: May 9, 2017

(54) MULTIPOLE ELECTRIC PLUG CONNECTOR PART

(71) Applicant: Kostal Kontakt Systeme GmbH, Luedenscheid (DE)

(72) Inventors: Volker Thurau, Dortmund (DE); Daniel Reimann, Schwerte (DE); Rene Reissmann, Werdohl (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 15/231,065

(22) Filed: Aug. 8, 2016

(65) Prior Publication Data

US 2016/0344130 A1 Nov. 24, 2016

Related U.S. Application Data

(63) Continuation of application No. PCT/EP2015/057248, filed on Apr. 1, 2015.

(30) Foreign Application Priority Data

Apr. 2, 2014 (DE) ..... 10 2014 004 832
Oct. 23, 2014 (DE) ..... 10 2014 015 715

(51) Int. Cl.
*H01R 13/58* (2006.01)
*H01R 13/436* (2006.01)
*H01R 13/52* (2006.01)

(52) U.S. Cl.
CPC ..... *H01R 13/436* (2013.01); *H01R 13/5205* (2013.01); *H01R 13/5825* (2013.01); *H01R 2201/26* (2013.01)

(58) Field of Classification Search
CPC H01R 13/5833; H01R 13/5829; H01R 13/58; H01R 13/506
(Continued)

(56) References Cited

U.S. PATENT DOCUMENTS 2,511,037 A * 6/1950 Bedoiseau ..... H01R 33/22 439/459
3,397,379 A * 8/1968 Puig ..... H01R 33/22 439/414
(Continued)

FOREIGN PATENT DOCUMENTS

DE 8901953 U1 5/1989
DE 29802470 U1 4/1998
(Continued)

OTHER PUBLICATIONS

European Patent Office, International Search Report for the corresponding International Application No. PCT/EP2015/057248 dated Sep. 2, 2015.

*Primary Examiner* — Gary Paumen
(74) *Attorney, Agent, or Firm* — Brooks Kushman P.C.

(57) ABSTRACT

A multipole electrical plug-in connector part includes a connector housing, a protective cap, and a clamping body. The protective cap is lockable to the connector housing and has an inlet opening. The protective cap further has a fixing section. The fixing section and the connector housing are connected together. The clamping body has elastically resilient clamping surfaces and is connected to the fixing section. Electrical connecting lines extending through the inlet opening toward the fixing section are mechanically fixed in a force-fit manner between the clamping surfaces of the clamping body and inner wall sections of the connector housing.

19 Claims, 11 Drawing Sheets

(58) Field of Classification Search
USPC ..... 439/456, 459, 460, 465, 467
See application file for complete search history.

(56) References Cited

U.S. PATENT DOCUMENTS

| | | | | | |
|---|---|---|---|---|---|
| 3,601,768 | A * | 8/1971 | Lightner | H01R 12/777 | 439/459 |
| 4,169,648 | A * | 10/1979 | Moist, Jr. | H01R 13/595 | 439/467 |
| 4,310,211 | A | 1/1982 | Bunnell et al. | | |
| 5,520,550 | A * | 5/1996 | Okabe | H01R 4/2429 | 439/404 |
| 5,588,870 | A * | 12/1996 | Boteler | H01R 13/502 | 439/467 |
| 6,113,420 | A * | 9/2000 | Harting | G02B 6/4471 | 439/407 |
| 6,238,236 | B1 | 5/2001 | Craft, Jr. | | |
| 6,431,881 | B1 * | 8/2002 | Engbring | H01R 12/592 | 439/459 |
| 7,011,553 | B2 * | 3/2006 | Hayashi | H01R 13/4367 | 439/460 |
| 7,641,503 | B1 * | 1/2010 | van der Horn | H01R 13/5812 | 439/457 |
| 2003/0199192 | A1 | 10/2003 | Caveney et al. | | |
| 2005/0003699 | A1 | 1/2005 | Fukui et al. | | |
| 2005/0095924 | A1 | 5/2005 | Hayashi et al. | | |
| 2013/0059462 | A1 | 3/2013 | Conroy | | |
| 2013/0189873 | A1 | 7/2013 | Maranto et al. | | |
| 2015/0280360 | A1 * | 10/2015 | Thelen | H01R 13/502 | 439/465 |

FOREIGN PATENT DOCUMENTS

| | | | |
|---|---|---|---|
| DE | 602004004974 | T2 | 6/2007 |
| DE | 102008055841 | A1 | 5/2010 |
| DE | 202013101929 | U1 | 6/2013 |
| EP | 0238316 | A2 | 9/1987 |

* cited by examiner a – a

A - A

B - B

MULTIPOLE ELECTRIC PLUG CONNECTOR PART

CROSS-REFERENCE TO RELATED APPLICATIONS

This application is a continuation of International Application No. PCT/EP2015/057248, published in German, with an International filing date of Apr. 1, 2015, which claims priority to DE 10 2014 004 832.2, filed Apr. 2, 2014, and DE 10 2014 015 715.6, filed Oct. 23, 2014; the disclosures of which are hereby incorporated in their entirety by reference herein.

TECHNICAL FIELD

The present invention relates to a multipole electrical plug-in connector part having a connector housing, a protective cap lockable to the connector housing and having an inlet opening, and a fixing device having a clamping body for mechanically fixing electrical connecting lines.

BACKGROUND

A plug-in connector part as set forth in the Technical Field is provided for establishing an electrical plug-in connection with another connector. The plug-in connector part is connected to one or more electrical connecting lines or cables. The connecting lines have to be securely connected to the connector housing of the plug-in connector part for reliable functioning when the plug-in connector part is not arranged stationary. It is customary to provide strain relief devices which prevent tensile forces acting on supply leads from being transmitted via the connecting lines to electrical plug contacts of the connector part or even interrupting electrical connections to the plug contacts.

For plug-in connector parts used under harsh environmental conditions, such as in the engine compartment of a motor vehicle, it is necessary to protect the electrical connection of the plug contacts from heavy vibration loads. This is difficult or achievable only with a relatively high level of effort for multipole electrical plug-in connector parts having a correspondingly large number of connecting lines.

German Utility Model DE 298 02 470 U1 describes a strain relief device. A clamp fixes a connecting line in a receiving slot. The clamp and the receiving slot together form a wedge pair. An inclined surface of the clamp is pushed beneath an edge of the receiving slot to form the wedge pair. In one refinement, teeth on the inclined surface cooperate with a detent mechanism at the edge of the receiving slot. The strain relief device allows fixing of multiple connecting lines. The connecting lines may have the same or different cross sections. A clamp and a receiving slot are provided for each individual connecting line. The clamp and the receiving slot individually interconnect into each other.

German Patent Application DE 10 2008 055 841 A1 describes a plug-in connector part having a housing part and a housing body. The housing body includes receiving chambers for electrical plug contact elements. Each contact element is connected to a respective electrical connecting line. The housing part is lockable to the housing body. In an end locking position, the housing part and housing body in cooperation enclose sections of the connecting lines in a form-fit manner.

Such a design is well suited for plug-in connector parts having a relatively small amount of connecting lines. The plug-in connector part described as an exemplary embodiment in DE 10 2008 055 841 A1 has two connecting lines. For a larger number of connecting lines, however, the design of such a plug-in connector part would be much more complicated and be relatively large in construction since each connecting line is individually enclosed by housing parts. In addition, the cross sections of the connecting lines cannot be freely chosen since they are to adapt to the shape of the housing parts.

SUMMARY

An object includes a plug-in connector part characterized by a high level of vibration resistance and with which a fairly large amount of individual electrical connecting lines, which may have different cross sections, can be securely fastened by clamping.

In carrying out at least one of the above and/or other objects, a multipole electrical plug-in connector part is provided. The connector part includes a connector housing, a protective cap, and a clamping body. The protective cap is lockable to the connector housing and has an inlet opening. The protective cap further has a fixing section. The fixing section and the connector housing are connected together. The clamping body has elastically resilient clamping surfaces and is connected to the fixing section. Electrical connecting lines extending through the inlet opening toward the fixing section are mechanically fixed in a force-fit manner between the clamping surfaces of the clamping body and inner wall sections of the connector housing.

Further, in carrying out at least one of the above and/or other objects, another multipole electrical plug-in connector part is provided. This connector part includes a connector housing, a protective cap, and a fixing device. The protective cap is locked to the connector housing and has an inlet opening. The fixing device includes a fixing section and a clamping body. The fixing section is connected to the protective cap. The clamping body is fastened to the fixing section and has elastically resilient clamping surfaces. Electrical connecting lines extending through the inlet opening toward the fixing section are mechanically fixed in a force-fit manner between the clamping surfaces of the clamping body and inner wall sections of the connector housing when the connector housing is joined to the fixing section.

An embodiment provides a multipole electrical plug-in connector part having a connector housing and a protective cap. The protective cap is lockable to the connector housing. The protective cap has an inlet opening. The plug-in connector part further has a fixing device for electrical connecting lines, wires or cables ("connecting lines"). The fixing device includes a clamping body. The clamping body has at least two clamping surfaces or faces ("clamping surfaces"). The clamping surfaces are elastically springy or resilient. The connecting lines can be mechanically fixed by a force fit between the clamping surfaces and inner wall sections of the connector housing. The clamping body can be formed as a resilient body or by clamping surfaces integrally molded in a sprung manner on the protective cap.

In embodiments, the clamping body is connected to the protective cap, the clamping surfaces of the clamping body are situated or formed on the clamping body in an elastically resilient or elastically flexible manner, and the connecting lines are mechanically fixable in a force-fit manner between the clamping surfaces and housing sections of the connector housing.

The elastically resilient or elastically flexible design of the clamping surfaces of the clamping body allows multiple individual connecting lines having the same or different cross sections to be mechanically fixed against the clamping body between the clamping surfaces and inner wall sections of the connector housing. In addition, any dimensional tolerances of the protective cap and of the connector housing are automatically compensated.

An elastically flexible design of the clamping surfaces enables the clamping surfaces of the clamping body to develop only relatively small restoring forces during a deflection. As such, when the clamping surfaces have an elastically flexible design, an option for positioning the connector housing and the protective cap relative to one another at stepped or staged intervals may be advantageously provided. Positioning the connector housing and the protective cap relative to one another at stepped or staged intervals builds up clamping forces due to the connector housing and the clamping surfaces being brought closer together. The clamping forces act on the connecting lines to sandwich the connecting lines between inner wall sections of the connector housing and the clamping surfaces of the clamping body.

Elastically resilient clamping surfaces may be designed in such a way that the multi-step positioning option between the connector housing and the protective cap is not necessary.

In an embodiment, the clamping body has an essentially V-shaped, rubber-elastic body. In this case, the clamping body is connected in a form-fit manner to a fixing section of the protective cap. The clamping body may have multiple integrally molded detent elements for connection to the protective cap.

In an embodiment, the protective cap and the clamping body is produced as a one-part component in a two-component injection molding process. The clamping body forms an elastomeric component on a protective cap made of a thermoplastic plastic.

In an embodiment, the clamping body is formed by multiple strip-like clamping arms. The clamping arms are integrally molded onto a fixing section of the protective cap in one piece. Outer surfaces of the clamping arms form clamping surfaces for mechanically fixing the connecting lines.

In embodiments, the mechanical fixing of the connecting lines takes place inside the plug-in connector part and not in the entry region of the protective cap. Circumferential ribs may thus be integrally molded on the inlet opening of the protective cap. The ribs may fix a plastic corrugated pipe or tube extending through the inlet opening to the plug-in connector part. The connecting lines are laid in bundles through the pipe or tube with splash-proof protection.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
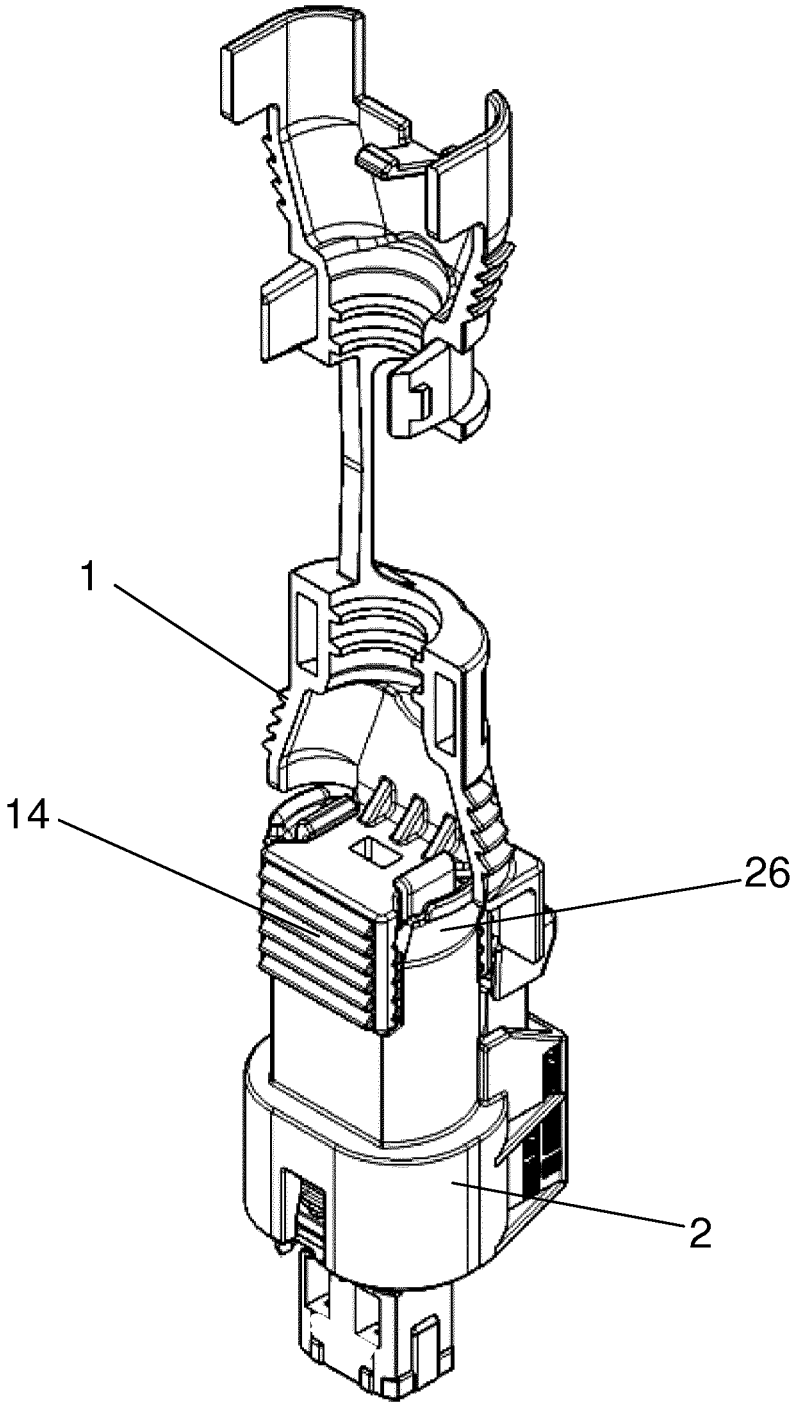
FIG. 1 illustrates a perspective view of a multipole electrical plug-in connector part in accordance with an embodiment.

Referring now to FIG. 1, a perspective view of a multipole electrical plug-in connector part in accordance with an embodiment of the present invention is shown. The plug-in connector part includes a protective cap 1 and a connector housing 2. Protective cap 1 is lockable or latchable to connector housing 2. Connector housing 2 houses multiple plug contact elements (not shown) such as plug contact sleeves and/or plug pins.

Figure 2:
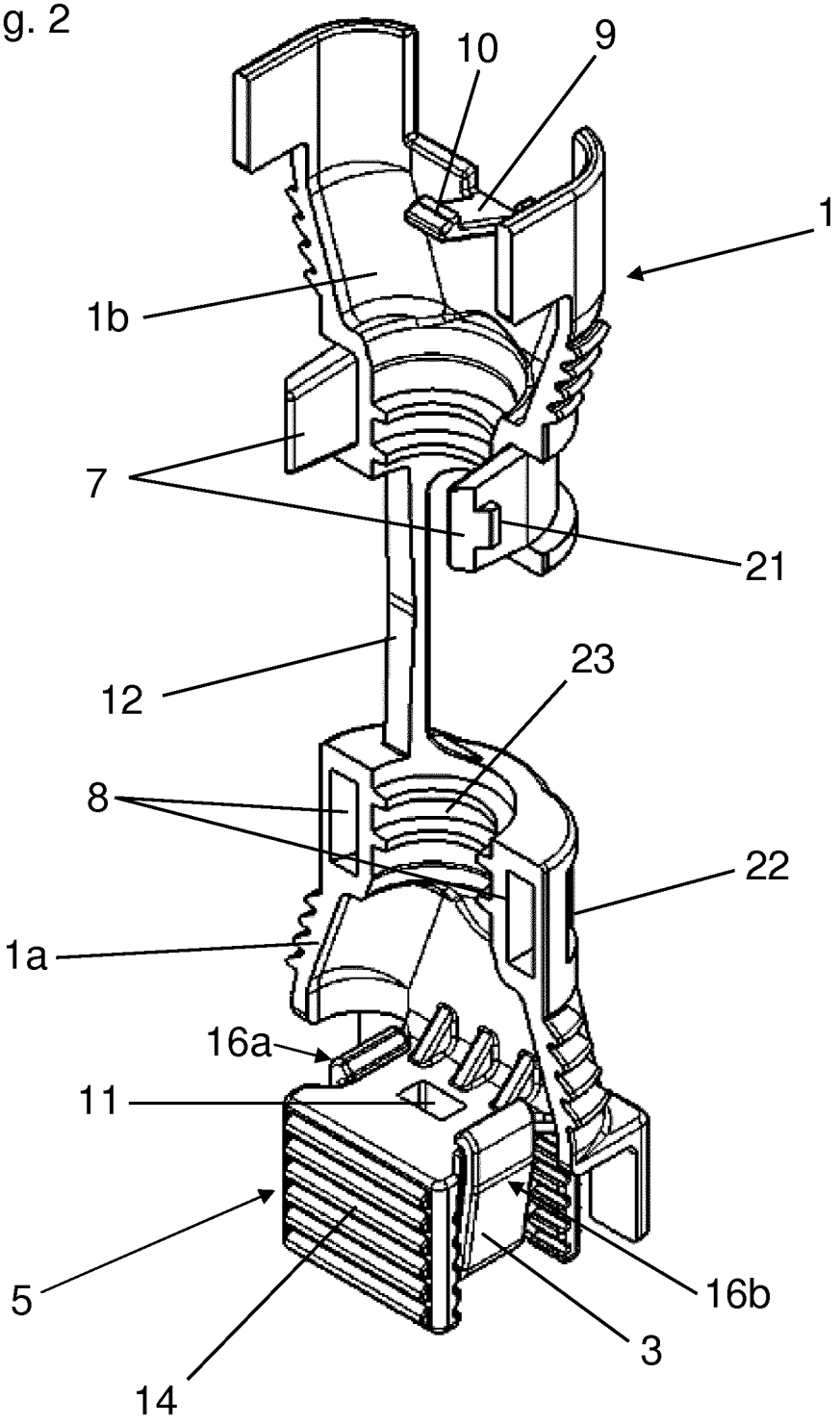
FIG. 2 illustrates a protective cap of the plug-in connector part with a clamping body of a fixing device of the plug-in connector part, the protective cap being in an opened position.
Figure 3:
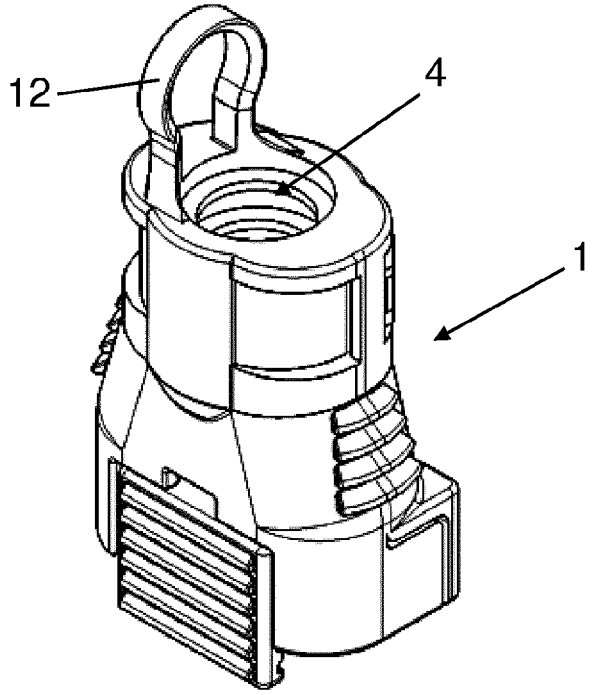
FIG. 3 illustrates the protective cap with the clamping body, the protective cap being in a closed position.

Protective cap 1 is illustrated in FIGS. 2 and 3 without connector housing 2. In FIG. 2, protective cap 1 is in an opened or unassembled position. In FIG. 3, protective cap 1 is in a closed or assembled position. Protective cap 1 includes first and second housing parts 1*a* and 1*b*. Housing parts 1*a* and 1*b* are formed in one piece and held together via a flexible film hinge 12.

Housing parts 1*a* and 1*b* are joined together for protective cap 1 to be in the closed position. Housing part 1*a* includes connecting elements 8 and housing part 1*b* includes connecting elements 7. Connecting elements 7 and 8 interlock to join housing parts 1*a* and 1*b* together. In particular, connecting elements 7 include detent hooks 21 integrally molded thereon and connecting elements 8 include detent openings 22 integrally molded thereon. Connecting elements 7 and 8 interlock with one another by detent hooks 21 engaging detent openings 22. Detent hooks 21 engaged with detent openings 22 fasten the upper sections of housing parts 1*a* and 1*b* to one another in a form-fit manner.

Housing part 1*b* further has a molded-on locking arm 9 with a detent projection 10. Detent projection 10, due to the elastic force of locking arm 9, is pushed into a detent recess 11 in first housing part 1*a* when housing parts 1*a* and 1*b* are joined together.

Joining housing parts 1*a* and 1*b* together results in the assembled protective cap 1 illustrated in FIG. 3. The assembled protective cap 1 has a closed lateral surface as shown in FIG. 3.

In FIGS. 1 and 2, protective cap 1 is illustrated in the opened or uninstalled state with housing parts 1*a* and 1*b* being unconnected to one another. This allows a view of further details of the plug-in connector part.

Protective cap 1 protects connector housing 2 from penetration of dust and moisture. Protective cap 1 additionally guides and mechanically fixes electrical connecting lines 6, 6*a*, 6*b*, 6*c* (illustrated in FIGS. 5, 6, 7, and 8). In its upper area, protective cap 1 has a relatively wide inlet opening 4. Inlet opening 4 includes molded-on circumferential ribs 23. A corrugated pipe or tube (not illustrated) extending through inlet opening 4 is connected to the plug-in connector part via inlet opening 4. Connecting lines 6, 6*a*, 6*b*, 6*c* are guided through the corrugated pipe or tube and thereby are protected from external environmental influences.

The plug-in connector part further includes a fixing device 5 for mechanically fixing connecting lines 6, 6*a*, 6*b*, 6*c*. Fixing device 5 includes a fixing section 14 of protective cap 1, a clamping body 3, and inner wall sections of connector housing 2. In this version of the plug-in connector part, clamping body 3 is rubber-elastic. Clamping body 3 rests against at least two side sections of protective cap 1 and is mounted to the protective cap.

Figure 4:
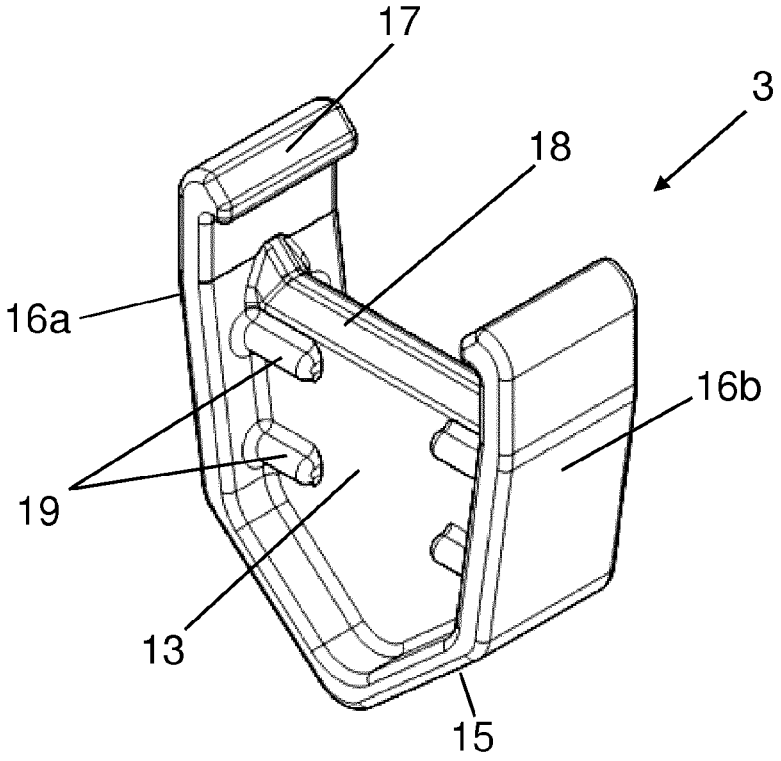
FIG. 4 illustrates the clamping body, the clamping body being a single part.

FIG. 4 illustrates clamping body 3 according to a version in which the clamping body is a single part. Alternatively, clamping body 3 may be an elastomer body that is injection-molded directly onto protective cap 1. In this alternate case, clamping body 3 and protective cap 1 may thus be produced as a single part in a two-component injection molding process.

The one-piece clamping body 3 shown in FIG. 4 is made of a flexibly pliable yet stable elastomeric material. As shown in FIG. 4, clamping body 3 includes an outer wall 15. Outer wall 15 is not completely circumferential and is made up of multiple flat face sections which are angled relative to one another. The two face sections of outer wall 15 adjoining the open side are referred to below as clamping surfaces or faces 16*a* and 16*b*. Clamping surfaces 16*a* and 16*b* are for mechanically fixing connecting lines in a clamping manner. Clamping surfaces 16*a* and 16*b* are oriented non-parallel to one another. The result is that clamping body 3 in the top view has an approximately V-shaped outer contour.

Outer wall 15 surrounds a connecting wall 18 having a pair of main faces 13. Main faces 13 are oriented at right angles to the faces of outer wall 15. Connecting wall 18 on both main faces 13 has multiple detent studs 19 molded on in one piece. The two free end sections of outer wall 15 have a rounded shape, thus forming two clip hooks 17.

Figure 9:
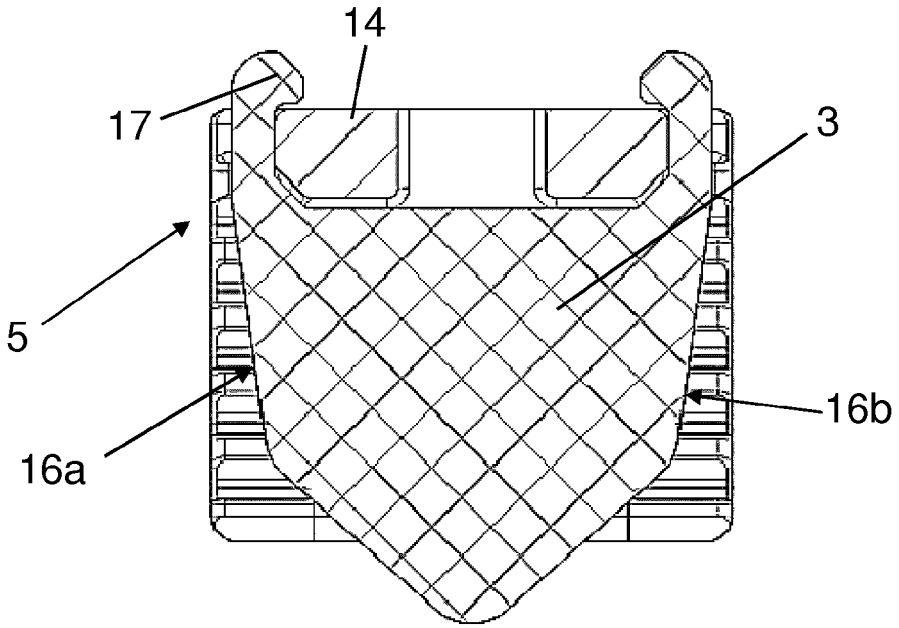
FIG. 9 illustrates a first sectional view of the fixing device.
Figure 10:
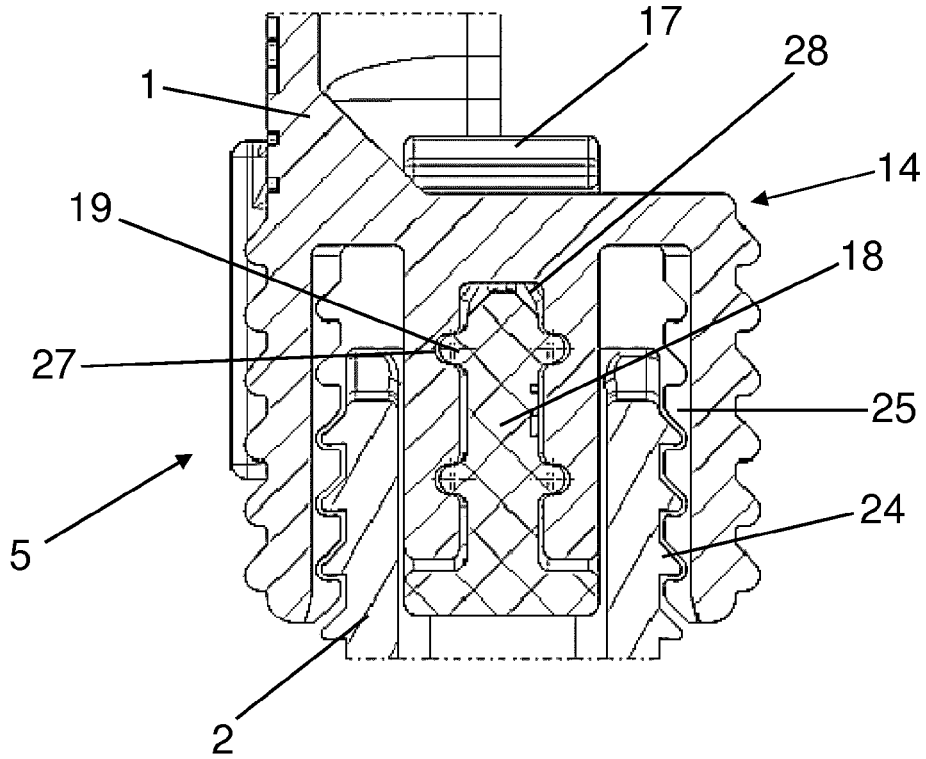
FIG. 10 illustrates a second sectional view of the fixing device.

Clip hooks 17 and detent studs 19 are used for fastening clamping body 3 to fixing section 14 of protective cap 1, as illustrated in FIGS. 9 and 10. FIG. 9 shows a sectional view through clamping body 3 which is fastened to fixing section 14. The sectional view of FIG. 9 is through the middle of connecting wall 18 in parallel to its main faces 13. This illustration shows how clip hooks 17 of rubber-elastic clamping body 3 wrap around fixing section 14, thus holding clamping body 3 on fixing section 14.

FIG. 10 shows another sectional view through the arrangement made up of clamping body 3 and fixing section 14. The sectional view of FIG. 10 is perpendicular to the direction of the sectional view of FIG. 9. As shown in FIG. 10, connecting wall 18 is inserted into a receiving slot 28 of fixing section 14. Detent studs 19 of connecting wall 18 engage with detent recesses 27 in receiving slot 28. Clip hooks 17 and detent studs 19 achieve secure fastening of clamping body 3 on fixing section 14 of protective cap 1. FIG. 2 shows a view of clamping body 3 fastened to protective cap 1.

A portion of connector housing 2 is also shown in FIG. 10. Connector housing 2 has integrally molded detent elements 24 which cooperate with detent elements 25 on protective cap 1. In this regard, detent elements 24 and detent elements 25 have a complementary shape. The cooperation between detent elements 24 and 25 results in multiple locking steps by which protective cap 1 and connector housing 2 are joined together in different positions in the axial direction. The asymmetrical shapes of detent elements 24 and 25 allow protective cap 1 and connector housing 2 to be brought together with relatively little effort. On the other hand, increasing the distance between protective cap 1 and connector housing 2 requires significantly greater effort or even the use of special tools.

As is apparent from FIGS. 2 and 9, clamping surfaces 16*a*, 16*b* of clamping body 3 are not oriented in parallel with one another or in parallel with the longitudinal axis of protective cap 1. When protective cap 1 is attached to connector housing 2, clamping surfaces 16*a*, 16*b* and inner walls of connector housing 2 are brought closer to one another with each ratchet of the detent mechanism. As a result, due to the increasingly smaller gap, connecting lines 6 extending between housing sections 26 of connector housing 2 and clamping surfaces 16*a*, 16*b* of clamping body 3 are clamped as the clamping surfaces are brought sufficiently close together.

Figure 5:
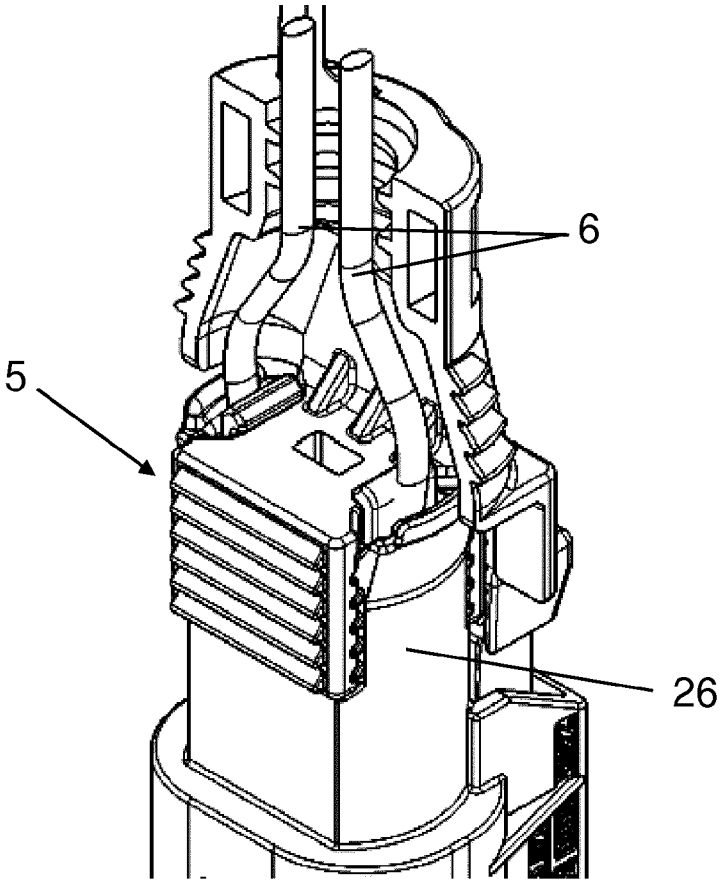
FIG. 5 illustrates the plug-in connector part in a partial sectional view.

The principle of mechanically fixing connector lines is illustrated in FIG. 5. An individual connecting line 6 is clamped between a housing section 26 and a clamping surface 16*a*. Due to the detent connection with multiple locking steps between protective cap 1 and connector housing 2, housing section 26 is brought close enough to clamping surface 16*a* that connecting line 6 is pressed deeply into the rubber-elastic material of clamping body 3.

Due to its rubber-elastic properties, clamping body 3 may also be attached close to multiple connecting lines lying next to one another. It is largely irrelevant whether the connecting lines have the same or different cross sections, as shown by three examples in FIGS. 6, 7, and 8.

Figure 6:
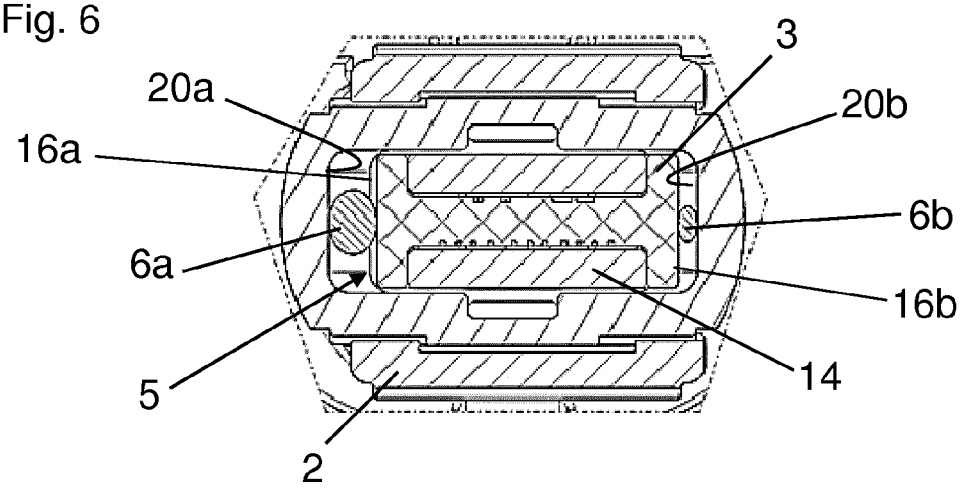
FIGS. 6, 7, and 8 illustrate respective cross-sectional views of the fixing device with different connecting line configurations.
Figure 7:
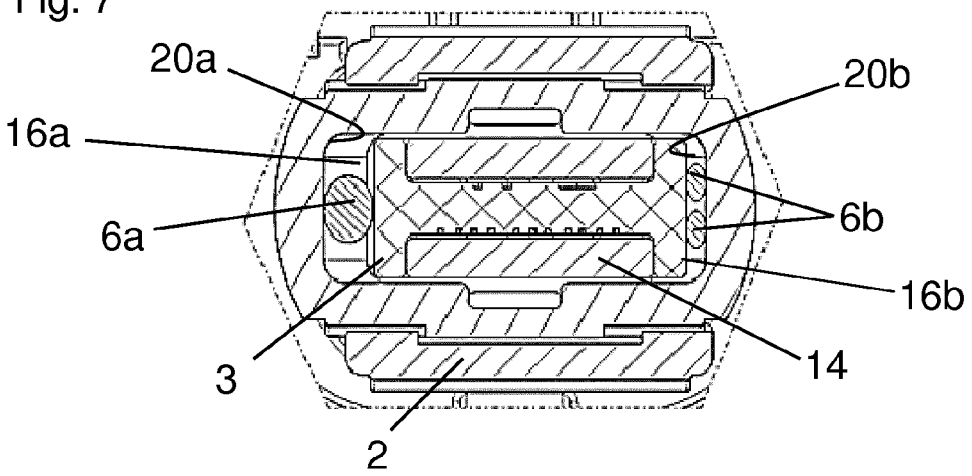
Figure 8:
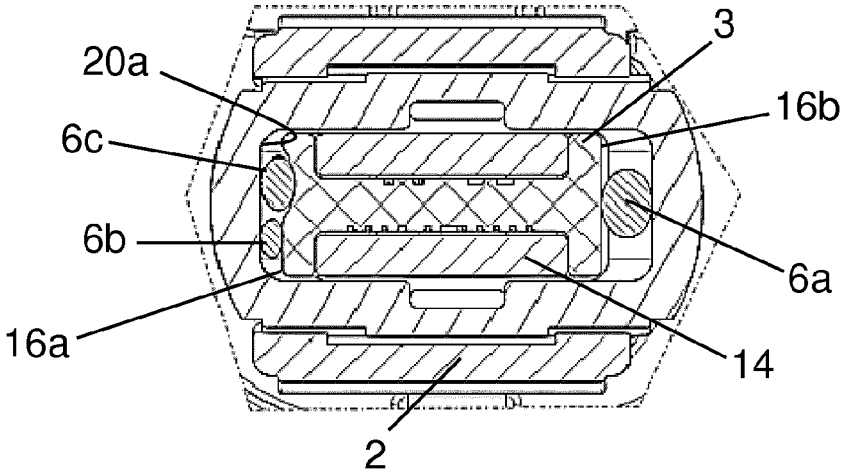

FIGS. 6, 7, and 8 show cross-sectional views of fixing device 5 which mechanically fixes connecting lines 6*a*, 6*b*, 6*c*. As shown in the cross-sectional views, connecting lines 6*a*, 6*b*, and 6*c* sometimes have the same or different cross sections. In FIG. 6, two connecting lines 6*a*, 6*b* having different line diameters are fastened by clamping body 3; on the left, clamping body 3 presses a connecting line 6*a* having a larger cross section, and on the right, presses a connecting line 6*b* having a smaller cross section, against the inner wall sections 20*a*, 20*b*, respectively, of connector housing 2.

FIGS. 7 and 8 show that more than one connecting line 6*a*, 6*b* may also be held by clamping surfaces 16*a*, 16*b*. FIG. 7 shows, by way of example, two connecting lines 6*b* having the same cross section which are fixed to inner wall section 20*b* by clamping surface 16*b*, while at the same time, clamping body 3 presses a connecting line 6*a* having a larger cross section against an oppositely situated inner wall section 20*a* of connector housing 2.

In the embodiment in FIG. 8, even three connecting lines 6*a*, 6*b*, 6*c*, all having different line cross sections, are mechanically fixed, whereby two connecting lines 6*b*, 6*c* having different line cross sections are mechanically fixed to the associated inner wall section 20*a* by the same clamping surface 16*a* of clamping body 3. Clamping body 3, made of rubber or some other rubber-elastic material, is sufficiently flexible to successfully fix both line thicknesses in a clamping manner.

Of course, these designs are understood to be strictly examples. In particular, it is possible to mechanically fix more than two connecting lines for each clamping surface. The amount of connecting lines that are fastenable by a clamping surface is determined by the cross sections of the connecting lines, the width and thickness of the clamping surfaces, and the material properties of the clamping body, or may be influenced by a suitable selection of these parameters.

Furthermore, the described clamping mechanism may be kinematically reversed. For example, a fixing section with a rubber-elastic clamping element is an integral part of connector housing 2 and cooperates with housing parts 1*a* and 1*b* of protective cap 1 when protective cap 1 is attached to connector housing 2.

Figure 11:
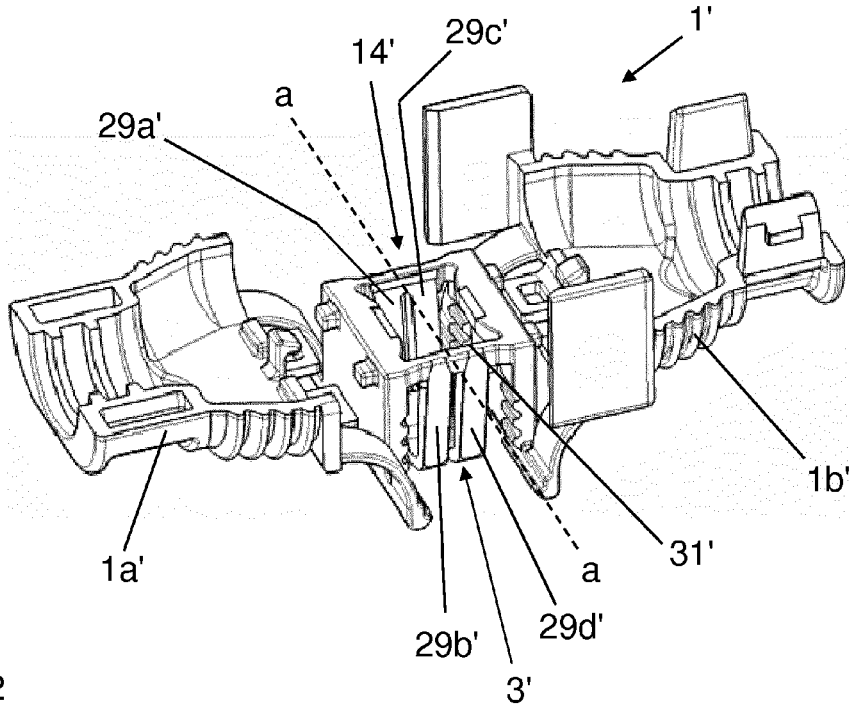
FIG. 11 illustrates the protective cap with another version of the clamping body.

FIG. 11 shows another design of a protective cap 1' with another version of a clamping body 3'. In this design, clamping body 3' is formed in one piece with protective cap P. The one-piece protective cap 1' is made up of two interlockable housing parts 1*a*' and 1*b*' which are joined together via two connecting webs 31'.

Figure 12:
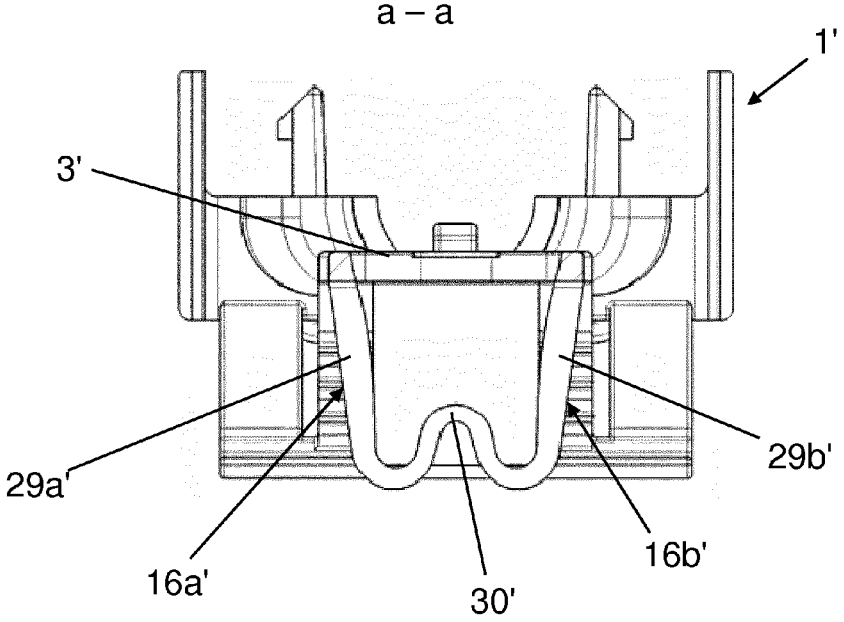
FIG. 12 illustrates a sectional view through the clamping body shown in FIG. 11.
Figure 13:
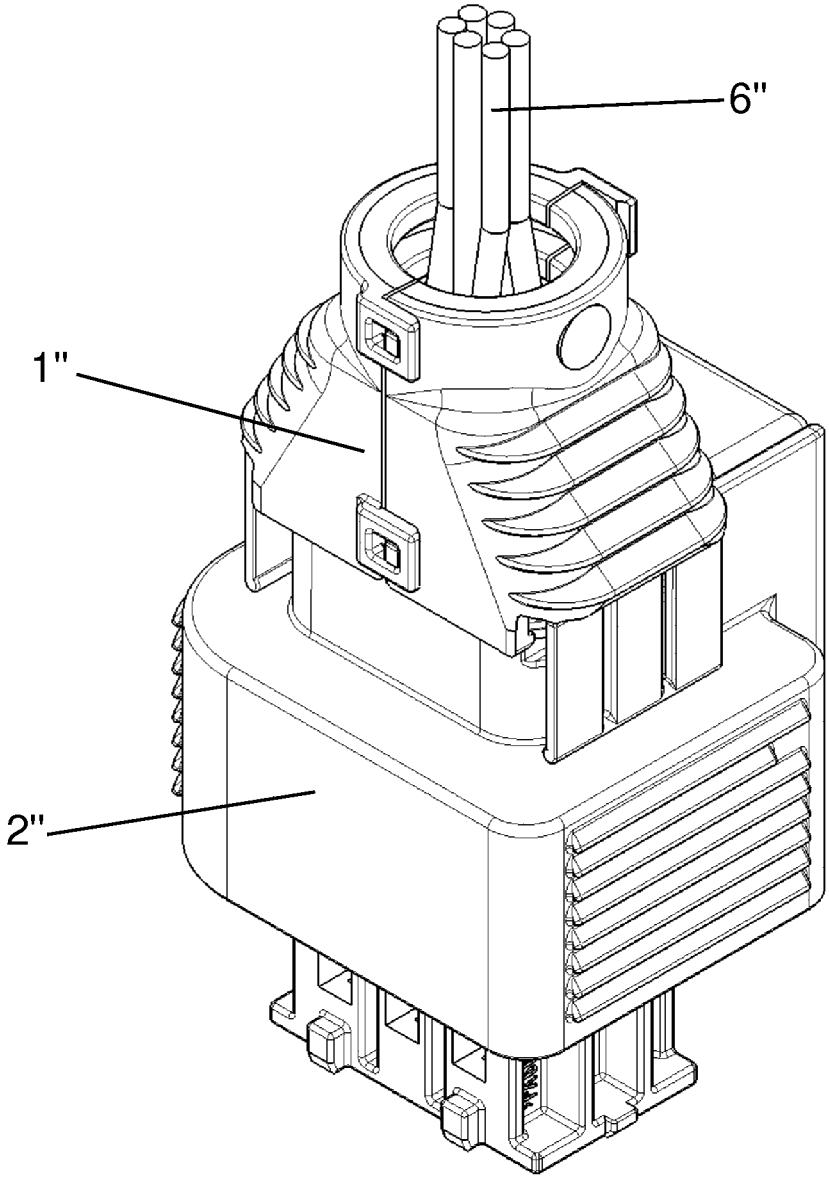
FIG. 13 illustrates a perspective view of a multipole electrical plug-in connector part in accordance with another embodiment.
Figure 14:
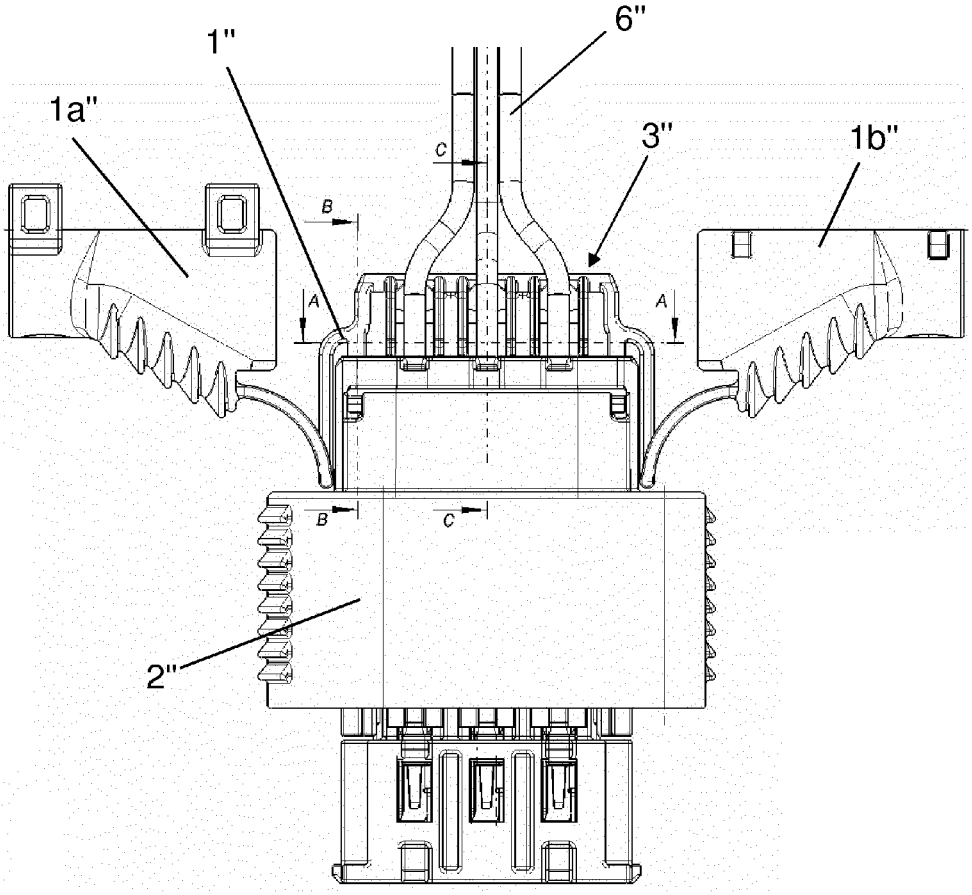
FIG. 14 illustrates the plug-in connector part shown in FIG. 13, the protective cap being in an opened position.
Figure 15:
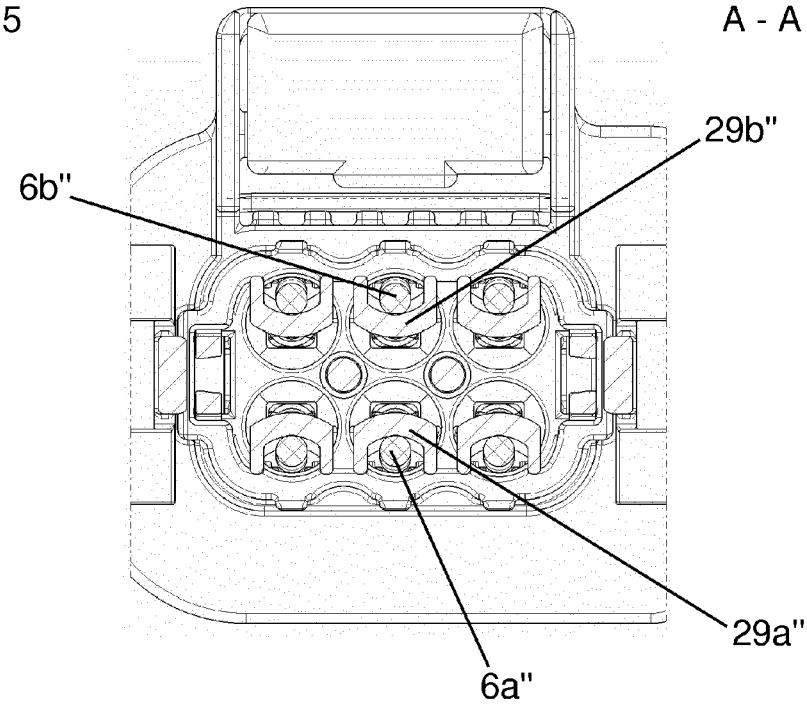
FIG. 15 illustrates a first sectional view through FIG. 13 of the plug-in connector part.
Figure 16:
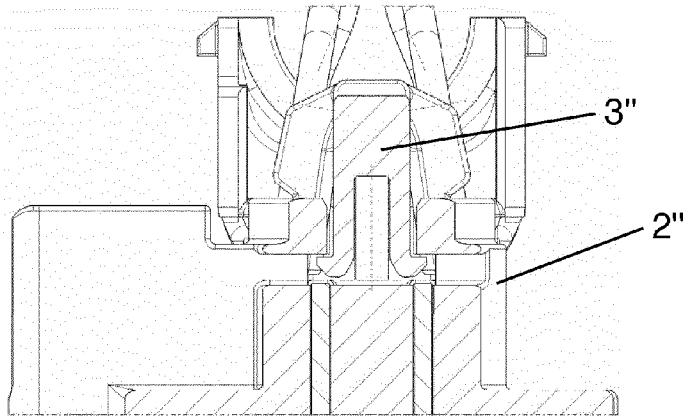
FIG. 16 illustrates a second sectional view through FIG. 13 of the plug-in connector part.
Figure 17:
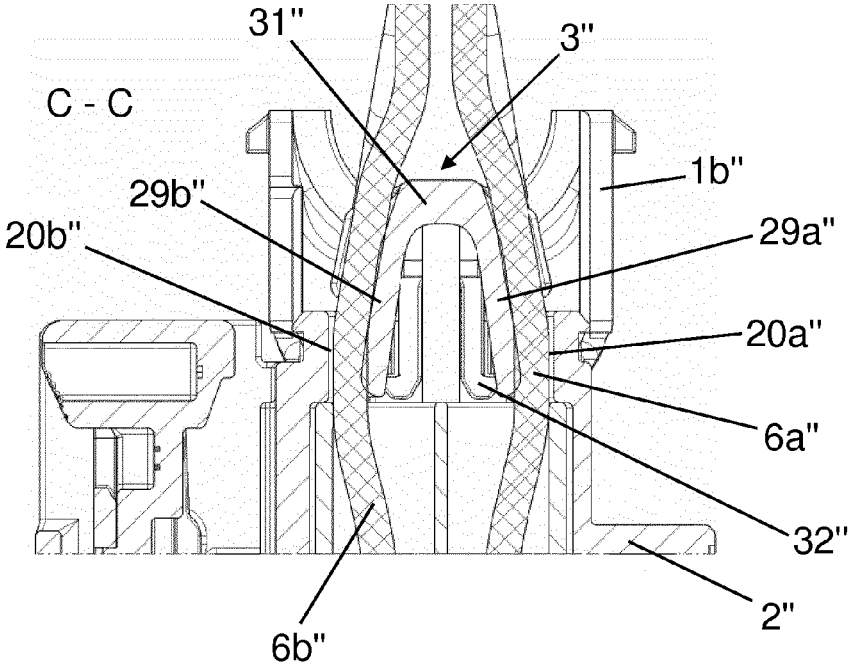
FIG. 17 illustrates a third sectional view through FIG. 13 of the plug-in connector part.

Connecting webs 31' also form a fixing section 14' of protective cap P. A total of four clamping arms 29*a*', 29*b*', 29*c*', 29*d*' are integrally molded in one piece on fixing section 14'. Clamping arms 29*a*', 29*b*', 29*c*', 29*d* are situated opposite from one another in pairs in a non-parallel arrangement. As shown in FIG. 12, which illustrates a sectional view through clamping body 3', clamping arms 29*a*', 29*b*', 29*c*', 29*d*' are connected via a multiply wound section 30'. Wound section 30' presses clamping arms 29*a*' and 29*b*' together under a pressure load, thus generating a spring-elastic counterforce. The outer surfaces of clamping arms 29*a*' and 29*b*' form clamping surfaces 16*a*' and 16*b*' which are able to fix connecting lines 6 to inner wall sections of connector housing 2.

Clamping body 3' illustrated in FIG. 11 has, by way of example, two of the W-shaped arrangements according to FIG. 12, which are made up of two clamping arms 29*a*', 29*b*' and 29*c*', 29*d*', respectively, and a flexible section 30'. These two arrangements are integrally molded in one piece, in parallel to one another, onto connecting webs 31'. Clamping body 3' in this case thus has a total of four clamping arms 29*a*', 29*b*', 29*c*', 29*d*', which correspondingly form the same amount of clamping surfaces. Of course, depending on the application, clamping body 3' may have a larger or smaller even number of clamping arms and clamping surfaces.

The mechanical fixing of connecting lines takes place in basically the same way as illustrated in FIGS. 5, 6, 7, and 8. As such, the mechanical fixing of connecting lines takes place by bringing protective cap 1' closer to connector housing 2 in steps, whereby sections of the inner housing wall of connector housing 2 are brought closer to clamping surfaces 16*a*' and 16*b*'.

In contrast to the exemplary embodiment described above, clamping surfaces 16*a*' and 16*b*' do not have a rubber-elastic design here. Thus, each connecting line is mechanically fixed to a separate clamping surface 16*a*' and 16*b*', whereby clamping arm 29*a*', 29*b*', 29*c*', 29*d*' supporting the particular clamping surface 16*a*' and 16*b*' is deflected sufficiently, depending on the cross section of the attached connecting line, so that each connecting line is individually mechanically fixed with a precise fit.

It may also be provided that individual clamping surfaces 16*a*' and 16*b*' each mechanically fix more than one connecting line. In this case, these connecting lines should have identical cross sections. Therefore, at least as many clamping arms 29*a*', 29*b*', 29*c*' and 29*d*' should be provided as the amount of different line cross sections that are used.

FIGS. 13, 14, 15, 16, 17, and 18 show another embodiment of a multipole electrical plug-in connector part in accordance with an embodiment. As with the embodiment shown in FIGS. 11 and 12, a separate clamping arm 29*a*" and 29*b*" is provided on clamping body 3" for each connecting line 6", 6*a*", and 6*b*" to be mechanically fixed.

Figure 18:
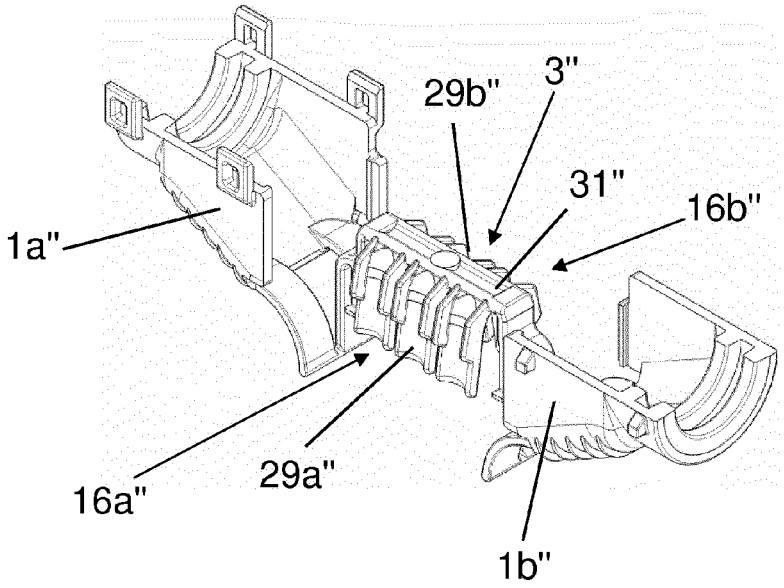
FIG. 18 illustrates the protective cap with the clamping body of the plug-in connector part shown in FIG. 13, the protective cap and the clamping body being a single part, the protective cap being in an opened position.

As shown in FIG. 18 clamping arms 29*a*" and 29*b*" are connected in one piece to a solid connecting web 31". Housing parts 1*a*" and 1*b*" of protective cap 1" are integrally molded in one piece to solid connecting web 31". The solid connecting web 31" brings about a mechanical decoupling of the clamping arms 29*a*" and 29*b*" so that when one clamping arm is deflected no significant displacement or deflection of another clamping arm can take place. This results in the advantage, compared to the embodiment illustrated in FIG. 11, that an uneven amount of connection lines, for example due to a plug-in connector which is not fully occupied, may also be securely mechanically fixed. A total of six clamping arms 29*a*" and 29*b*" illustrated in this example are connected to clamping body 3" in such a way that they may be elastically deformed by the pressure of the connecting lines 6", 6*a*", 6*b*" to be fixed. The width of the gap between an inner wall section 20*a*" and 20*b*" of connector housing 2" and the respective clamping arm 29*a*" and 29*b*" correspondingly changes depending on the connection line diameter. Due to this functional principle, connecting lines 6", 6*a*", 6*b*" having different cross sections may be fixed by a force fit.

Connecting lines with a large diameter have greater mass and must be mechanically fixed correspondingly more firmly than connecting lines having a small diameter. This is achieved by the elastic connection of clamping arms 29*a*" and 29*b*" to connecting web 31", since the deflection of clamping arms 29*a*" and 29*b*" increases with increasing line cross section, in turn resulting in an increasing clamping force.

In contrast to the embodiments described above, in this case no multi-step detent positioning between protective cap 1" and connector housing 2" is necessary due to the relatively large elastic forces which may be applied by clamping arms 29*a*" and 29*b*". Instead, protective cap 1" is clipped to connector housing 2" via detent hooks 32". This simplifies assembly compared to establishing a multi-step detent connection and contributes significantly to minimization of errors. Due to the lock between protective cap 1" and connector housing 2" inside protective cap 1", the lock is also protected from access from the surroundings so that inadvertent release of the lock is precluded.

This design is also advantageous compared to the subject matter in Utility Model DE 298 02 470 U1 cited above. Threading connecting lines through openings is not necessary here. Connecting lines 6", 6*a*", 6*b*" may be pushed aside on both sides of connector housing 2, after which protective cap 1 may be locked on and its housing parts 1*a*", 1*b*" joined together. In addition, manual placement of a plurality of clamping pieces is not necessary here.

LIST OF REFERENCE NUMERALS

1, 1', 1" Protective cap
1*a*, 1*b*, 1*a'*, 1*b'* 1*a"*, 1*b"* Housing parts of protective cap
2, 2" Connector housing
3, 3', 3" Clamping body
4 Inlet opening
5 Fixing device
6, 6*a*, 6*b*, 6*c*, 6", 6*a"*, 6*b"* Connecting lines
7, 8 Connecting elements
9 Locking arm
10 Detent projection
11 Detent recess
12 Film hinge
13 Main faces
14, 14' Fixing section
15 Outer wall
16*a*, 16*b*, 16*a'*, 16*b'*, 16*a"*, 16*b"* Clamping surfaces of clamping body
17 Clip hook
18 Connecting wall
19 Detent studs
20*a*, 20*b*, 20*a"*, 20*b"* Inner wall sections
21 Detent hook
22 Detent openings
23 Ribs
24, 25 Detent elements
26 Housing sections
27 Detent recesses
28 Receiving slot
29*a'*, 29*b'*, 29*c'*, 29*d'*, 29*a"*, 29*b"* Clamping arms
30' Flexible sections
31', 31" Connecting web(s)
32" Detent hook While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A multipole electrical plug-in connector part comprising:

a connector housing;

a protective cap lockable to the connector housing and having an inlet opening, the protective cap further having a fixing section, the fixing section and the connector housing being connected together;

a clamping body having elastically resilient clamping surfaces, the clamping body having a V-shape and being connected to the fixing section; and wherein electrical connecting lines extending through the inlet opening toward the fixing section are mechanically fixed in a force-fit manner between the clamping surfaces of the clamping body and inner wall sections of the connector housing.

2. The connector part of claim 1 wherein:

the clamping body is a rubber-elastic material and is connected to the fixing section of the protective cap in a form fit manner.

3. The connector part of claim 1 wherein:

the fixing section of the protective cap and the clamping body are a unitary component.

4. The connector part of claim 1 wherein:

the clamping surfaces are oriented non-parallel to one another.

5. The connector part of claim 1 wherein:

the clamping body includes clamping arms elastically situated on the fixing section of the protective cap and a spring-elastic flexible section joining the clamping arms together, the clamping arms respectively having the clamping surfaces with the clamping surfaces being oriented non-parallel to one another.

6. The connector part of claim 1 wherein:

the clamping body has clamping arms situated non-parallel to one another, the clamping arms respectively having the clamping surfaces.

7. The connector part of claim 1 wherein:

the fixing section of the protective cap and the connector housing are axially positionable with respect to one another in multiple locking steps through detent elements to be connected together such that different spacing is between the clamping surfaces of the clamping body and the inner wall sections of the connector housing depending on the axial positioning.

8. The connector part of claim 1 wherein:

the protective cap includes two housing parts formed in one piece, the housing parts of the protective cap being joinable together.

9. The connector part of claim 1 wherein:

the inlet opening of the protective cap has molded-on ribs.

10. A multipole electrical plug in connector part comprising:

a connector housing;

a protective cap lockable to the connector housing and having an inlet opening, the protective cap further having a fixing section, the fixing section and the connector housing being connected together;

a clamping body having elastically resilient clamping surfaces, the clamping body being connected to the fixing section;

wherein the clamping body includes clamping arms elastically situated on the fixing section of the protective cap, the clamping arms respectively having the clamping surfaces; and wherein electrical connecting lines extending through the inlet opening toward the fixing section are mechanically fixed in a force-fit manner between the clamping surfaces of the clamping arms of the clamping body and inner wall sections of the connector housing.

11. A multipole electrical plug-in connector part comprising:

a connector housing;

a protective cap locked to the connector housing and having an inlet opening;

a fixing device including a fixing section and a clamping body, the fixing section connected to the protective cap, the clamping body fastened to the fixing section, the clamping body having elastically resilient clamping surfaces; and wherein electrical connecting lines extending through the inlet opening toward the fixing section are mechanically fixed in a force-fit manner between the clamping surfaces of the clamping body and inner wall sections of the connector housing when the connector housing is joined to the fixing section.

12. The connector part of claim 1 wherein:

the fixing section includes a receiving slot and the clamping body further includes a connecting wall, the connecting wall is inserted into the receiving slot to secure the fastening of the clamping body to the fixing section.

13. The connector part of claim 12 wherein:

the receiving slot of the fixing section includes detent recesses and the connecting wall of the clamping body includes detent studs, the detent studs engage with the detent recesses to secure the fastening of the clamping body to the fixing section.

14. The connector part of claim 1 wherein:

the connector housing is axially positionable with respect to the fixing section in multiple locking steps through detent elements for the connector housing to be joined to the fixing section with spacing between the clamping surfaces of the clamping body and the inner wall sections of the connector housing depending on the axial positioning.

15. The connector part of claim 14 wherein:

the clamping surfaces of the clamping body are oriented non-parallel with one another and the clamping surfaces move toward being oriented parallel with one another as the spacing between the clamping surfaces and the inner wall sections of the connector housing decreases as the connector housing is further joined to the fixing section through each locking step to thereby mechanically fix the electrical connecting lines between the clamping surfaces and the inner wall sections of the connector housing.

16. The connector part of claim 11 wherein:

the clamping body is a rubber-elastic material.

17. The connector part of claim 11 wherein:

the clamping body has a V-shape.

18. The connector part of claim 11 wherein:

the protective cap includes two housing parts formed in one piece, the housing parts of the protective cap being joinable together, the fixing section is connected to one of the housing parts of the protective cap to be connected to the protective cap.

19. The connector part of claim 11 wherein:

the inlet opening of the protective cap has molded-on ribs.

* * * * *